US005429228A

United States Patent [19]

Dahl

[11] Patent Number: 5,429,228

[45] Date of Patent: Jul. 4, 1995

[54] BUSINESS CARD CAROUSEL INDEX SYSTEM

[76] Inventor: Terrold L. Dahl, 516 Riverside Dr. #3, Pocatello, Id. 83204

[21] Appl. No.: 257,074

[22] Filed: Jun. 8, 1994

Related U.S. Application Data

[63] Continuation of Ser. No. 926,004, Aug. 5, 1992, abandoned.

[51] Int. Cl.[6] ..... B65D 79/00

[52] U.S. Cl. ..... 206/45.13; 206/425; 312/186

[58] Field of Search ..... 206/425, 45.13; 312/186, 319.2; 40/377, 379

[56] References Cited

U.S. PATENT DOCUMENTS

| | | | |
|---|---|---|---|
| Re. 30,624 | 5/1981 | Soulakis et al. | 206/45.13 |
| 2,703,744 | 3/1955 | Karper | 40/379 |
| 3,261,649 | 7/1966 | Erickson et al. | 40/379 |
| 3,279,471 | 10/1966 | Ruina | 312/186 |
| 3,747,245 | 7/1973 | Ladine | 40/379 |
| 4,035,938 | 7/1977 | Neilsen | 40/379 |
| 4,091,918 | 5/1978 | Soulakis et al. | 206/45.13 |
| 4,204,351 | 5/1980 | Hawkins | 40/379 |
| 4,599,815 | 7/1986 | Waldo | 40/377 |
| 4,729,475 | 3/1988 | Kurkjian et al. | 206/425 |
| 4,749,098 | 6/1988 | Verdi | 220/22.5 |
| 4,906,057 | 3/1990 | Davi et al. | 312/193 |

FOREIGN PATENT DOCUMENTS

| | | | |
|---|---|---|---|
| 167702 | 5/1954 | Australia | 40/379 |
| 612424 | 11/1948 | United Kingdom | 40/377 |

OTHER PUBLICATIONS

Woodhouse Office Supplies Catalog, "Card-O-Rama" Rotary Filing System, Item 142-1, 1962.

*Primary Examiner*—David T. Fidei
*Assistant Examiner*—Thomas P. Hilliard

[57] ABSTRACT

A business card carousel index system having a housing comprised of a base and a lid. The housing encloses a carousel to which business cards are mounted. The carousel is attached through support and placement arms through the lid and a base so that operation of the lid will alter the distance between the carousel and the base. In use, a business card may be punched utilizing a flexing device located at the front of the housing, after which the punched card may be placed upon rings on the carousel. When a user wishes to access the cards contained within the housing, the lid of the housing is lifted thereby elevating the carousel above the base of the housing, so that rotational movement will be allowed. When the lid is closed, the carousel is lowered and the business cards are divided into two substantially planar arrays which allow for a reduced profile of the height which can be placed within a briefcase, while at the same time allowing for a carousel type action when the carousel is elevated above the base of the housing.

17 Claims, 5 Drawing Sheets

BUSINESS CARD CAROUSEL INDEX SYSTEM

This application is a continuation of U.S. application Ser. No. 07/926,004, filed Aug. 5, 1992, now abandoned, for BUSINESS CAROUSEL INDEX SYSTEM.

BACKGROUND

1. The Field of the Invention

The present invention relates generally to a card indexing or filing system. More specifically, the present invention relates to a portable, compact business card holder capable of being carried within a briefcase.

2. Background Art

A variety of organizational devices, known as card indexing systems or card filing systems are utilized to index and store cards which contain information for later reference or review.

Such indexing and filing systems typically consist of a horizontal storage channel wherein cards such as three inch by five inch cards are placed. A recipe card box is a typical example. The cards can be arranged alphabetically, by subject, or in some other manner, sections of which are separated by dividers indicating the alphabetical sequence or subject of the section of cards.

The user must scan these dividers until the proper section of cards is found, and must then further consult the cards within that section for the specific card desired.

Various-sized cards and papers are often loosely stored within a recipe box type indexing system. The variation in size, color, thickness, etc. of the cards and papers detracts from the organization and unity of the system and requires additional effort during searching. Moreover, although the loose placement of cards into a horizontal channel allows for their quick removal, this does not prevent a removed card from becoming lost, torn or otherwise rendered unusable.

One solution to these problems has been the rotating carousel card filing system. This system provides cards which are uniform in size, color and thickness. The desired information is written or typed onto the cards. The rotating carousel card filing system also provides for the storage and safekeeping of the cards by the use of storage rails. The cards carried on these rails have two holes punched at the bottom of each card which the storage rails penetrate. The rails can be opened, allowing for card removal, but the rails are closed when cards are not being added in order to prevent loss or mutilation of the cards.

One problem encountered with the rotating carousel card filing system is that the cards used are larger than business cards. Thus, the rotating carousel card filing system does not lend itself to the filing of business cards. Business cards do not have holes in them, and their dimensions are typically two inch by three and one-half inch, whereas the rotating carousel card filing system is designed for the filing of prepunched cards which are three inch by five inch. As a result, in order for a business card to be placed in the system, the information must be retyped onto one of the system cards or the business card itself must be attached to a system card.

Another problem with the filing of business cards in a rotating carousel card filing system is that the information is randomly located on the card such that any hole-punching done to the business cards may obliterate some of the information contained thereon.

An additional problem is that the rotating carousel card filing systems are not designed to be portably compact. In order to provide a rotatable circular array of cards, these systems have a minimum height equal to two cards plus the diameter of the carousel. This prevents rotating carousel card filing systems from being used in a portable manner because they are simply too tall.

Another problem with rotating carousel card filing systems with respect to business cards is that business cards are often obtained away from the office at some location remote from an appropriately configured hole-punch. The user must then place the card into a pocket or billfold and then remember the card when arriving back at the office. If the card does not get lost or destroyed in the meantime, the user must then wrestle with the problem of how to place the card into the rotating carousel card filing system without obliterating any of the information contained thereon. This often results in the cumbersome task of punching holes in the bottom of the business card with some hole punch found at the office which does not conform exactly to the rotating carousel card filing system.

When the business card is finally placed onto the system, its smaller size detracts from the organizational uniformity of the filing system. In order to prevent this scenario, some users will perform the cumbersome task of typing the information from the business card onto one of the system cards, or taping the business card onto one of said cards.

OBJECTS AND BRIEF SUMMARY OF THE INVENTION

Accordingly, it is an object of the present invention to provide a portable business card carousel index system for business cards having a profile short enough such that the entire device will fit into a briefcase.

It is another object of the invention to provide a rotatable circular storage channel for the placement of business cards such that the user's eye need not scan the cards but may remain fixed in one position for review of the cards while the rotatable circular storage channel is turned by hand.

An additional object of the invention is to provide a mechanism for punching holes in business cards for placement into the portable business card carousel index system, the mechanism being attached to the system.

It is yet another object of the invention that the mechanism for punching holes in business cards be configured so as to punch holes in predetermined strategic areas such that little or no information is obliterated.

To achieve the foregoing objects, and in accordance with the invention as embodied and broadly described herein, a business card carousel index system is provided for use capable of being transported in a briefcase. The business card carousel index system comprises a housing having a base and a lid. The lid has an upper surface from which orthogonally depend a front, back and sides. The base has a bottom, front, back and sides. The lid is hingedly attached to the base. A carousel is contained within the housing formed by the lid and base. A means for altering the position of the carousel above the base of the housing as the lid of the housing is operated is provided to allow access to cords mounted on the carousel.

An alternative embodiment may, by way of example, but without limitation, Include a ridge protruding inwardly from an inner surface of the bottom of the base.

The carousel contained within the housing has rotatable circular storage rings to which business cards may be attached. The storage rings are mounted on a carousel shaft. The carousel may also further comprise a means for rotating the carousel shaft. The means for rotating the carousel shaft may by way of example, but without limitation, comprise a rotating knob.

The means for altering the position of the carousel above the base of the housing as the lid is operated includes a supporting arm attached to the carousel shaft of the carousel and a positioning mechanism attached to the lid at one end. The supporting arm is attached to the carousel shaft of the carousel at the other end. The positioning mechanism may comprise a first arm attached to the shaft of the carousel at one end and the second arm attached to the lid at one end and the first arm at the other end.

One embodiment of the business card carousel index system may further include fanning means for causing friction with the business cards so that the business cards are separated. The fanning means may by way of example, but without limitation, comprise a first arm attached at the lid at one end, a second arm attached to the shaft of the carousel at one end and the first arm at the other end, and a flexible tab positioned where the first arm attaches to the second arm.

The housing may by way of example, but without limitation, further comprise integral means for punching holes in business cards. In one preferred embodiment, the means for punching holes in business cards comprise a floor for supporting a portion of a business card as holes are punched in the business card, guides formed parallel to the sides of the base of the housing, and a stop-shelf formed perpendicular to the guides. The stop-shelf serves to limit the travel of a business card place on the floor of the receiving channel thereby positioning a business card as holes are punched therein.

Another alternative embodiment of the claimed invention includes a means for punching holes in business cards. The punching means comprises a punch enclosure, a plurality of punching studs held in the punch enclosure, a receiving slot, and ejection aperture. The receiving slot is formed in the front of the punch enclosure and is sized and configured for receiving a business card. The receiving slot has a floor and an opening. The ejection aperture is formed in the floor of the receiving slot through which punched portions of the business card may be ejected from the punch enclosure.

The invention also contemplates a method for strategically punching holes in business cards having sides at a location in the business cards where little or no information is obliterated. The method comprises the steps of positioning the business card and punching device such that holes may be punched substantially one-half way up one side of the business card and punching holes in the business card.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings.

Understanding that these drawings depict only typical embodiments of the invention and are not, therefore, to be considered limiting of its scope, the invention will be described and explained with additional specificity and detailed through the use of the accompanying drawings in which.

DESCRIPTION OF THE PREFERRED EMBODIMENTS

Figure 1:
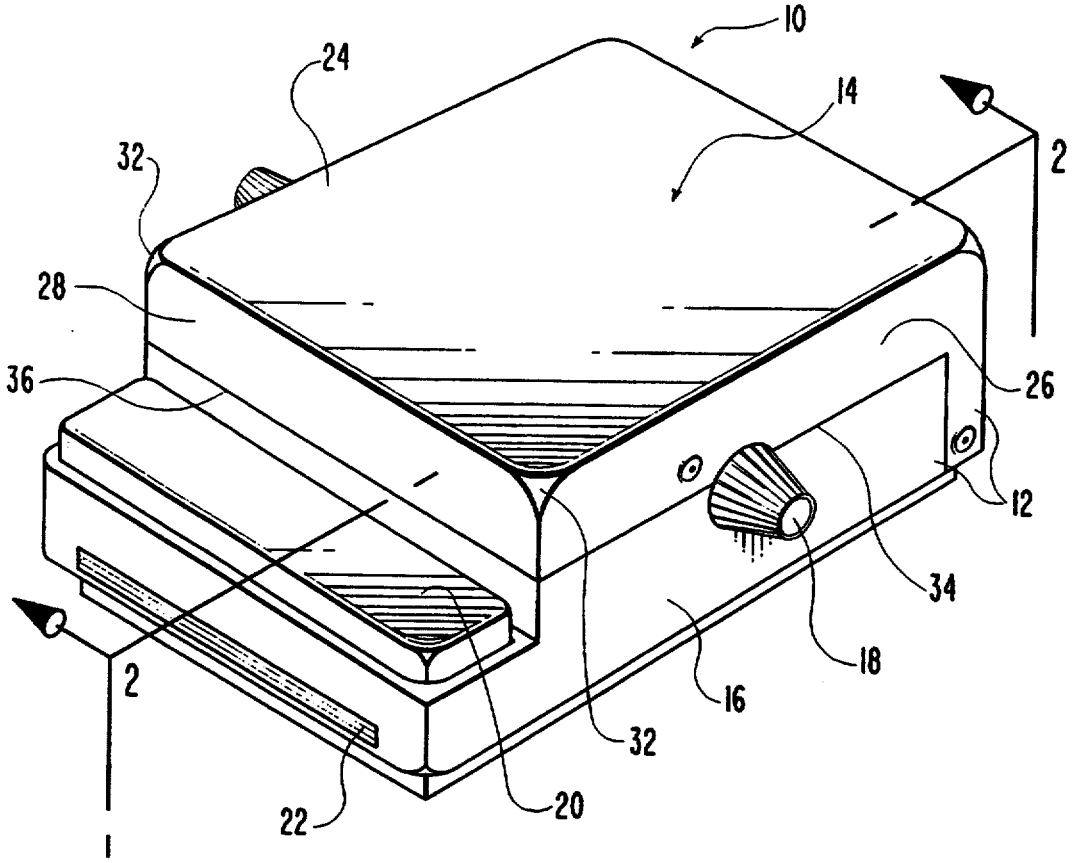
FIG. 1 is a perspective view of the business card carousel index system illustrating a housing with the lid closed.

A perspective view of one embodiment of a business card carousel index system 10 is illustrated in FIG. 1 in which a housing 12 comprises a lid 14 and a base 16. Housing 12 serves to shield the business cards held therein from dust and damage while the business card carousel index system is being transported within the brief case of a user.

The business card carousel index system of the present invention provides a means for rotating the carousel shaft. By way of example, without limitation, the means for rotating the carousel shaft of the embodiment illustrated in FIG. 1 comprises rotating knob 18.

Protruding out of housing 12 when housing 12 is in a closed position is a rotating knob 18 used to rotate the carousel (not shown in FIG. 1) and a punch bar 20 used in punching the holes in business cards prior to mounting the business cards on the carousel. A card slot 22 penetrates a base 16 of housing 12 to allow insertion of a business card therein whereupon actuation of punch bar 20 through a mechanism to be described later punches holes in the business card.

Base 16 and lid 14 of housing 12 are so sized and configured so as to allow the entire housing 12 to be placed within a briefcase. To accommodate this, lid 14 has an upper surface 24 which is smooth and flat. Sides 26 formed perpendicular to upper surface 24 are relatively free of protrusions except rotating knob 18. A front 28 is formed perpendicular to upper surface 24.

In addition to having smooth surfaces, business card carousel system 10 has rounded corners 32 which protect the inside of the brief case in which the business card carousel index system is transported. Lid 14 mates with base 16 at an edge 34 of sides 26 in edge 36 of front 28 to form an enclosure.

Figure 2:
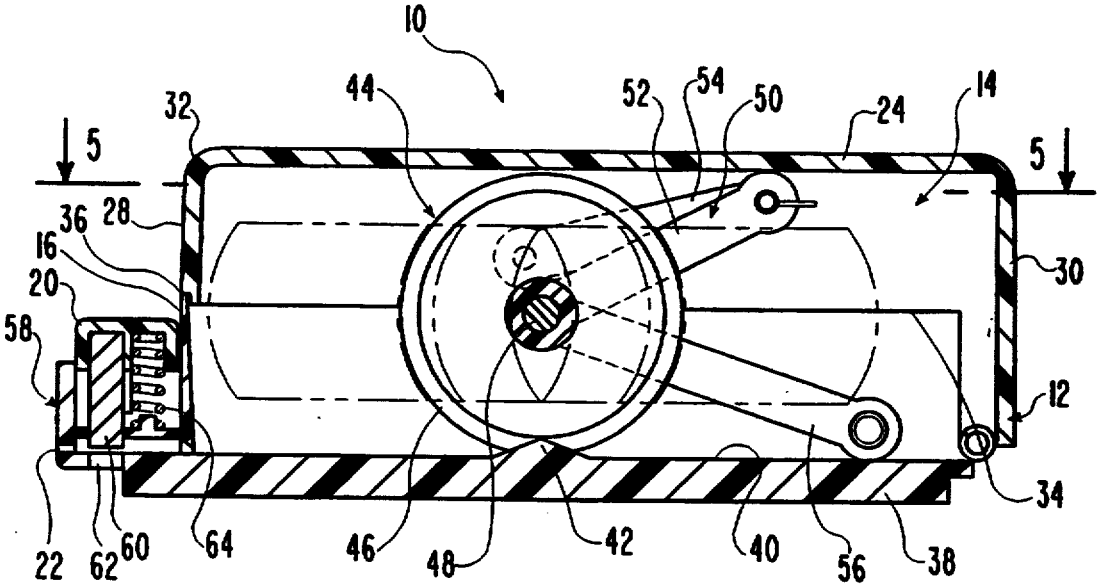
FIG. 2 is a longitudinal cross-section taken along lines 2—2 in FIG. 1.

To more fully appreciate the inner mechanisms of the business card carousel index system 10, reference is now made to FIG. 2 in which a cross-section taken along lines 2—2 in FIG. 1 is depicted.

In FIG. 2, base 16 is illustrated having a bottom 38 having in inner surface 40 from which protrudes a ridge 42. Enclosed within housing 12 is a carousel 44 constructed of two, rotatable storage rings 46 mounted on a carousel shaft 48. Carousel 44 is raised out of base 16 when lid 14 is opened. A positioning mechanism 50 comprised of a first arm 52 attached to the lid 14 and a second arm 54 attached to the carousel shaft 48 work in conjunction with a supporting arm 56 to raise carousel 44 out of base 16 when the user wishes to access the cards mounted on the carousel.

Protruding from the front of base 16 is a punch enclosure 58. Punch enclosure 58 contains the mechanisms that operate to punch the business cards inserted through card slot 22 when punch bar 20 is operated. Downward pressure exerted by a user on punch bar 20 forces a punching stud 60 through an ejection aperture 62 thereby ejecting the portion of the card which is punched. A return spring 64 urges punch bar 20 back to its original position.

Figure 3:
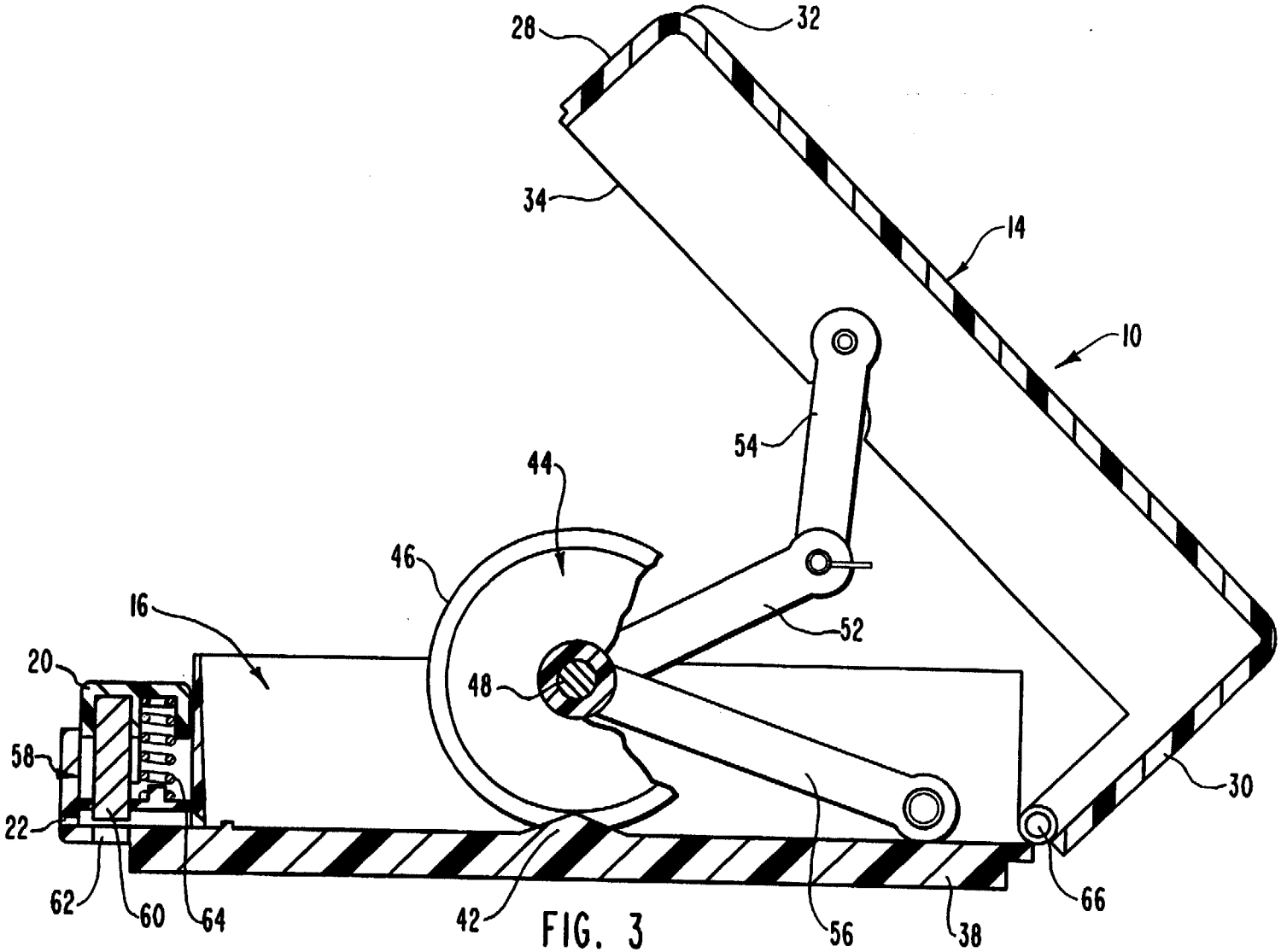
FIG. 3 is a longitudinal cross-section of index system shown in FIG. 2 with the lid open at a 45 degree angle.

As illustrated in FIG. 3, as lid 14 is opened, second bracing arm 54 is pivoted in an upward direction away from first bracing on 52. As lid 14 continues to be opened, the angle between second bracing arm 54 and first bracing arm 52 becomes more obtuse until the angle equals 180° and carousel 44 is lifted from base 16. Carousel 44 travels in an arc as it is lifted from base 16, the arc being dictated by supporting arm 56 which is attached to base 16. The length of the arc through which carousel 44 travels is limited at its bottom by contact between carousel 44 bottom 38 of base 16 and at the upper end of the arc by the restrictions placed upon the travel of lid 14 and attached first bracing arm 52 and second bracing of 54.

The business card carousel index system of the present invention provides a means for moving the location of the carousel between the first position for storage and second position above the base of the housing as the lid of housing is operated. By way of example, without limitation, the means for moving the location of the carousel in the embodiment illustrated in FIG. 3 comprises first bracing arm 52, second bracing arm 54, and supporting arm 56.

Figure 4:
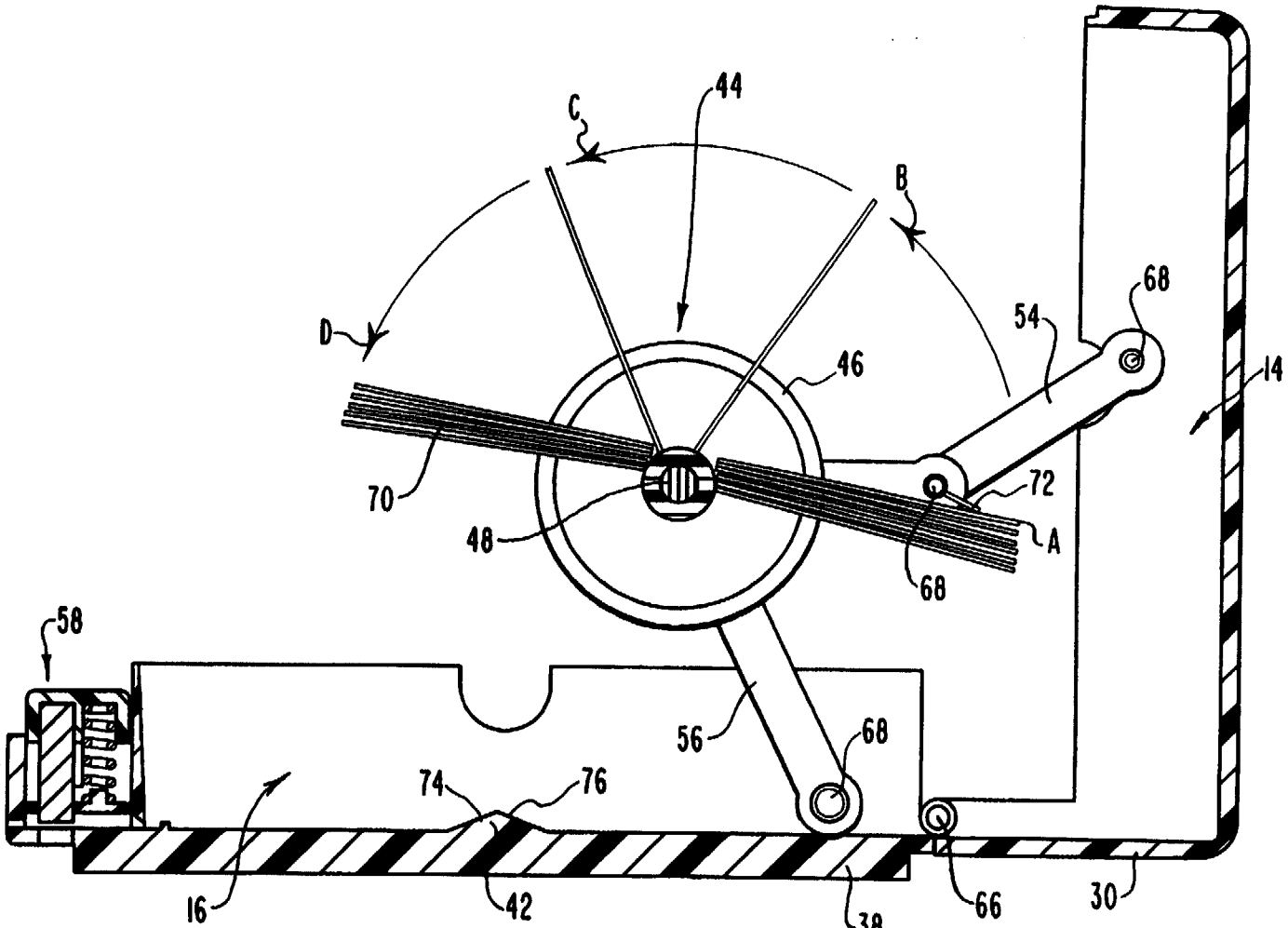
FIG. 4 is a longitudinal cross-section of an index system like that illustrated in FIG. 3 showing the lid fully opened at a 90 degree angle.

As illustrated in FIG. 4, when back 30 of lid 14 becomes substantially parallel with bottom 38 of base 16, first bracing arm 52 and second bracing arm 54 cease to exert tension on carousel 44 thereby limiting the travel of carousel 44 at the upper end of its arc of travel. As lid 14 is hingedly attached to base 16 at hinge 66, back 30 of lid 14 abuts bottom 38 of base 16 preventing further travel of carousel 34. In addition to hinge 66, first bracing arm 52 and second bracing arm 54 along with supporting arm 56 are all hingedly interconnected by connecting hinges 68.

As carousel 44 is raised out of base 16, business cards 70 are forced by gravity to fall from the substantially planar array taken when the housing is closed, into a semi-circular array in which the segment of the circle that is empty is oriented opposite bottom 38 of base 16.

When a user wishes to access a particular business card, carousel shaft 48 is rotated by some mechanism such as rotating knob 18 illustrated in FIG. 1, thereby radially circulating business card 70 about the longitudinal axis of carousel shaft 48. Rotation of carousel shaft 48 causes rotation of rotatable circular storage rings 46 to which the business cards are attached.

Although the punched holes formed within the business cards allow only a slidable attachment to rotatable circular storage rings 46, friction on rotatable circular storage rings 46 caused by a plurality of business cards stacked atop each other causes the business cards to rotate concurrently with rotation of rotatable circular storage rings 46.

As also illustrated in FIG. 4, counterclockwise rotation of business cards 70 about rotatable circular storage rings 46 causes business cards 70 to come into contact with the separating tab 72. Separating tab 72 protrudes inward from first bracing arm 52 to slightly impede the progress of business cards 70. The purpose of separating tab 72 is to allow individual viewing of each business card as the business cards travel through the portion of the path of travel of the business cards which is opposite bottom 37 of base 16.

By applying torque to carousel shaft 48, a user applies pressure to the business card nearest separating tab 72 at a position indicated as A. Business cards at position A are under pressure and are urged in a counterclockwise circulation by torque applied to carousel shaft 48. As the pressure at position A becomes sufficient, the business card will pass beyond separating tab 72 and travel in an upward arc to position B where a user may grasp the card to read information contained thereon or a user may allow business card 70 to continue on to position C wherein gravity will act upon business card 70 to pull business card 70 onto the stack of business card located at position D. Although the business card illustrated in FIG. 4 are located in a substantially planar array, such an array is only accomplished when the business cards are stored within the closed housing or upon initial opening of lid 14. After the initial movement of lid 14 or of rotational movement by carousel shaft 48, gravity acts upon the cards in this substantially planar array to pull the cards down into a semi-circular array.

After use, however, the semi-circular array of cards must be reconfigured into a substantially planar array of cards to allow lid 14 to close upon base 16. To accomplish this, ridge 42 is provided protruding upwardly from an inner surface of bottom 38 to engage the business cards as lid 14 is closed upon base 16. Business cards lowered upon a front ramp 74 of ridge 42 will be guided in a direction toward punch enclosure 58. As successive cards are engaged by front ramp 74, those cards will force cards preceding them in a direction toward punch enclosure 58.

Those cards initially encountering back ramp 76, however, will be forced in a direction toward hinge 66 eventually resulting in the formation of a substantially planar array of business cards allowing rotatable circular storage rings 36 to contact the upper surface of bottom 38 thereby allowing lid 13 to close upon base 16.

Figure 5:
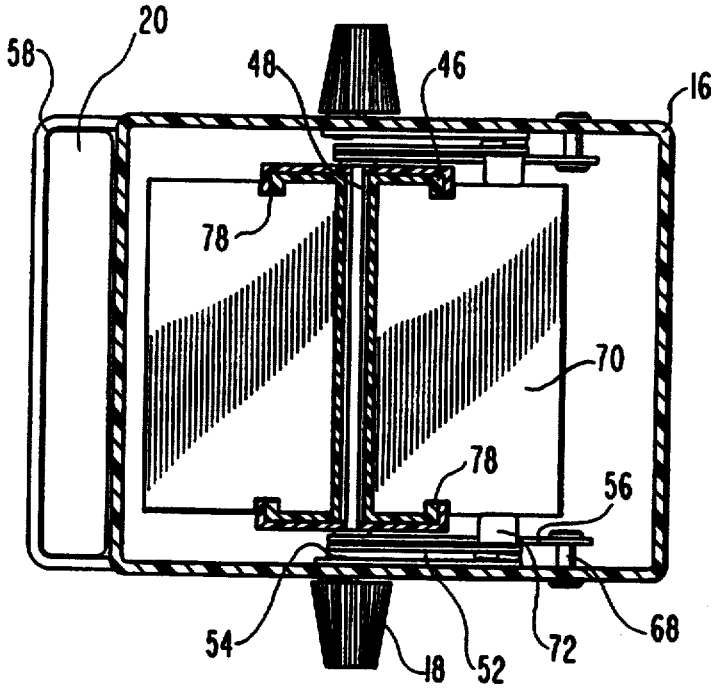
FIG. 5 is a longitudinal cross-section taken along lines 5—5 in FIG. 1.

The operation of separating tab 72 is further illustrated in FIG. 5 wherein separating tab 72 can be seen in slight contact with business cards 70. Also illustrated in FIG. 5 is the position of punch bar 20 in punch enclosure 58. When a user acquires a new business card, the card may be inserted into the front of housing 12 and holes may be formed therein by depressing punch bar 20 as described earlier. After appropriate holes are punched in the business card, the business card is slid between the pair of opposing card guides 78. Card guides 78 are formed integral with rotatable circular storage rings 46 and serve to transmit torque generated at rotating knob 18 and applied to carousel shaft 48 along rotatable circular storage rings 46 to card guides 78. Although the business card illustrated in the embodiment shown in FIG. 5 is punched at a point intermediate the bottom and a half-way point along the side of the card, the presently preferred location for the punching of holes within a business card is illustrated in FIG. 6 in which the punches are formed substantially half-way along the sides of the business card.

The business card carousel index system provides means for spreading apart the business cards. By way of example, without limitation, the fanning means of the embodiment illustrated in FIG. 5 comprise separating tabs 72.

Figure 6:
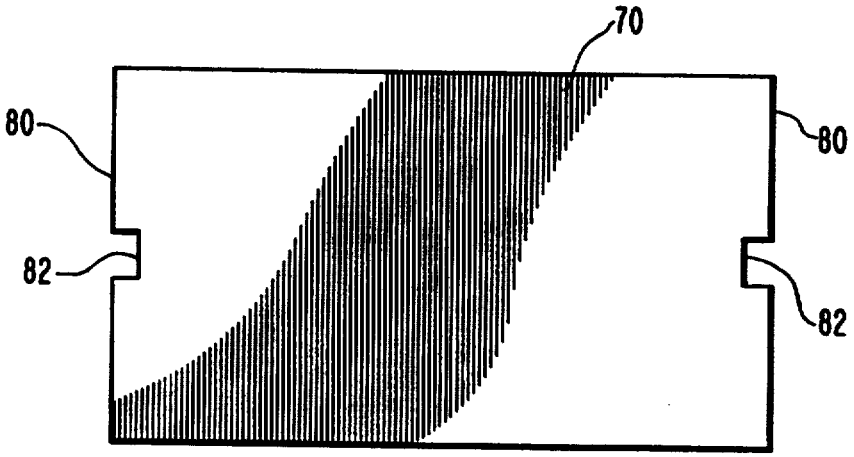
FIG. 6 is a cross-section taken along lines 6—6 in FIG. 2.

In FIG. 6, business card 70 shown having sides 80 having holes 82 fall within sides 80. To determine this preferred location of the hole within a business card, a test was performed in which a one to one scale multi-element template illustrating twelve methods of punching the business cards was utilized. A business card was selected at random from a stack of approximately six-hundred cards and one by one placed under the template. Each time a card was placed in the template which, if used, would delete name, address, phone number or other important information, it was marked as a failure. The results of the test revealed that standard punch locations as used in other carousel type systems create the highest failure rate, as they punch out the greatest amount of information, which when applied to a business card application leaves the card useless. The test revealed that cards punched substantially half-way along the sides of the business card had a very small failure rate when compared to punches placed in other locations. The results of this test are included in Appendix A which is hereby incorporated by specific reference herein.

Figure 7:
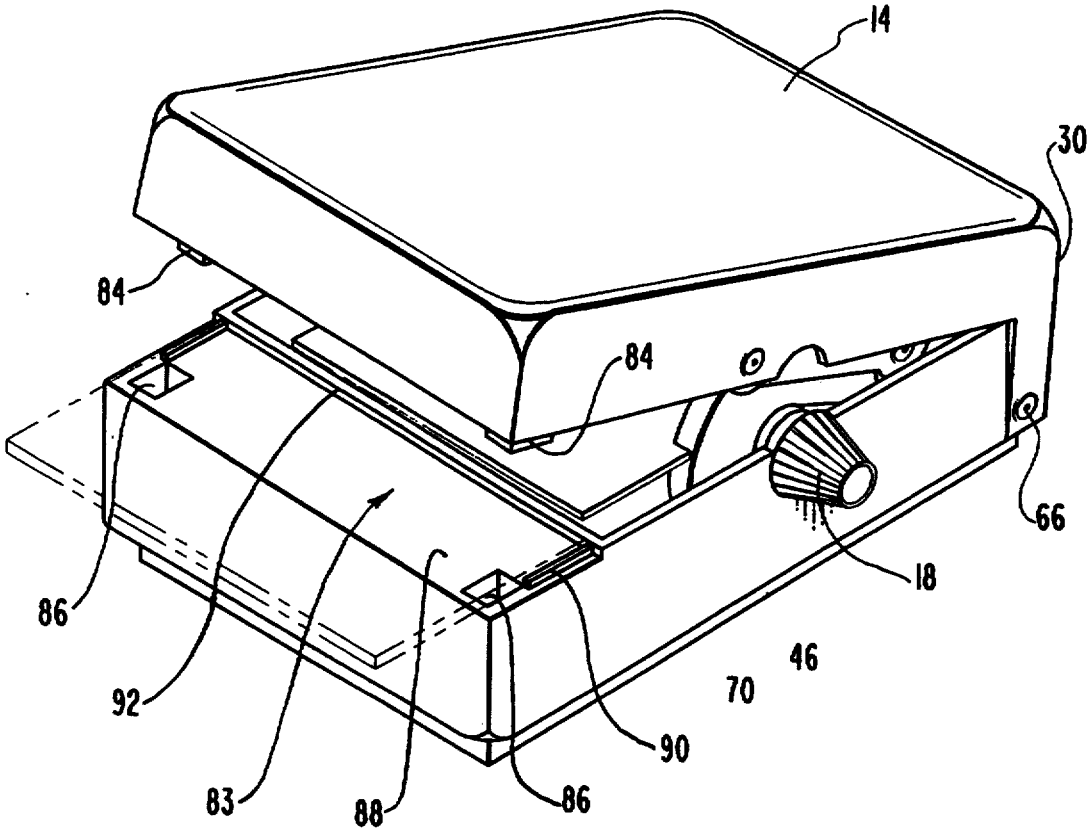
FIG. 7 is a perspective view of an alternative embodiment.

FIG. 7 illustrates an altering embodiment of the present invention having a receiving channel 83 formed within base 16. Receiving channel 83 has a floor 88 guides 90 formed parallel to the sides of base 16, a stop-shelf 92 formed perpendicular to the guides. Also illustrated in FIG. 7 are punching studs 84 formed integral with lid 14 and receiving apertures 86 formed and floor 88 of receiving channel 83. Punching studs 84 and receiving apertures 86 are sized and configured so as to cooperate in punching holes through the business card placed upon floor 88 an abutment with stop-shelf 92.

The business card carousel index system provides integral means for punching holes in business cards. By way of example, without limitation, the integral means for punching holes in business cards in the embodiment illustrated in FIG. 7 comprises a receiving channel 83 formed in the base of the housing for receiving a portion of a business card, a plurality of punching studs 84 formed in the lid capable of forming holes in the business card of a shape conforming to the rotatable circular storage rings, and the plurality of receiving apertures 86 forming the receiving channel cooperatively engaging one of the plurality of punching studs.

The receiving channel comprises a floor 88 for supporting a portion of a business card while holes are punched in the business card, guides 90 form contiguous with the floor and a stop-shelf 92 formed perpendicular to the guides, the stop-shelf serving to limit the travel of a business card placed on the floor of the receiving channel, thereby positioning the business card when holes are punched therein.

The means for moving the location of the carousel above the base of the housing and another embodiment may also comprise supporting arm 56 and positioning mechanism 50. Positioning mechanism 50 is comprised of the first bracing arm 52 attached to the shaft of the carousel at one end and the second bracing arm 54 attached to the lid at one end and to the first bracing arm 52 at the other end.

I claim:

1. A business card carousel index system comprising:
(a) a carousel having rotatable circular storage rings to which business cards may be attached, the storage rings being mounted on a carousel shaft;
(b) a housing enclosing the carousel, the housing having a base and a lid, the base having a bottom, and the lid being hingedly attached to the base so as to be movable between a closed position and an open position, the lid and the base being separated by a distance greater than a distance defined by the diameter of the storage rings and less than a distance defined by the diameter of the storage rings plus the height of one business card; and
(c) means for moving the location of the carousel between a first position for storage to a second position above the base of the housing as the lid of the housing is operated.

2. A business card carousel index system as recited in claim 1, wherein the lid has an upper surface from which orthogonally depend a front, back and sides.

3. A business card carousel index system as recited in claim 2, wherein the base has upstanding therefrom a bottom, front, back and sides.

4. A business card carousel index system as recited in claim 1, the carousel further comprising means for rotating the carousel shaft.

5. A business cared carousel index system as recited in claim 4, wherein the means for rotating the carousel shaft comprises a rotating knob.

6. A business card carousel index system as recited in claim 1, wherein the means for moving the location of the carousel above the base of the housing comprises:
(a) a supporting arm attached to the carousel shaft of the carousel; and
(b) a positioning mechanism attached to the lid at one end and to the carousel shaft of the carousel at the other end.

7. A business card carousel index system as recited in claim 6, wherein the positioning mechanism comprises:
(a) a first arm attached to the shaft of the carousel at one end; and
(b) a second arm attached to the lid at one end and the first arm at the other end.

8. A business card carousel index system as recited in claim 6, wherein the means for altering the position of the carousel above the base of the housing further comprises one or more bracing arms attached to the housing.

9. A business card carousel index system as recited in claim 1, wherein the carousel index system further comprises fanning means for spreading apart the business cards.

10. A business card carousel index system as recited in claim 9, wherein the means for moving the location of the carousel comprise:
(a) a first arm attached to the lid at one end; and
(b) a second arm attached to the shaft of the carousel at one end and the first arm at the other end.

11. A business card carousel index system as recited in claim 1, wherein the housing further comprises integral means for punching holes substantially one-half way up one side of a business card.

12. A business card carousel index system as recited in claim 11, wherein the integral means for punching holes substantially one-half way UP one side of a business card comprises:
(a) a punch enclosure;
(b) a plurality of punching studs held in the punch enclosure, each of the plurality of punching studs being so sized and configured as to be capable of punching holes in a business card;

(c) a receiving slot formed in the front of the punch enclosure, the receiving slot so sized and configured for receiving a business card; the receiving slot having a floor and an opening;

(d) An ejection aperture formed in the floor of the receiving slot through which punched portions of the business card may be ejected from the punch enclosure; and (e) a stop shelf perpendicular to the guides, the stop shelf serving to limit the travel of a business card placed on the floor of the receiving channel, thereby positioning the business card so that holes may be punched substantially one-half way up one side thereof.

13. A business card carousel index system as recited in claim 1, wherein the carousel further comprises means for separating business cards on the carousel as the lid is operated.

14. A business card carousel index system as recited in claim 13, wherein the means for separating business cards comprises a ridge protruding inwardly from an inner surface of the bottom of the base.

15. A business card carousel index system as recited in claim 11, wherein the integral means for punching holes substantially one-half way up one side of a business card comprises:

(a) a receiving channel formed in the base of the housing for receiving a portion of a business card;

(b) a plurality of punching studs, each of the plurality of punching studs formed in the lid for forming holes substantially one-half way up one side of a business card of a shape conforming to the rotatable circular storage rings; and (c) a plurality of receiving apertures formed in the receiving channel cooperatively engaging one of the plurality of punching studs.

16. A business card carousel index system as recited in claim 15, wherein the receiving channel comprises:

(a) a floor for supporting a portion of a business card as holes are punched in the business card;

(b) guides formed contiguous with the floor; and (c) a stop shelf perpendicular to the guides, the stop shelf serving to limit the travel of a business card placed on the floor of the receiving channel, thereby positioning the business card when holes are punched therein.

17. A business card carousel as recited in claim 10, wherein the fanning means comprises a flexible tap positioned where the first arm attaches to the second arm.

* * * * *